US005659989A

United States Patent [19]

Hsiao et al.

[11] Patent Number: 5,659,989

[45] Date of Patent: Aug. 26, 1997

[54] WHEEL COVER

[76] Inventors: Leslie Hsiao, 120 Barrington Dr.; Jeffrey R. Spiker, 9921 Adamo Dr., both of Tampa, Fla. 33634

[21] Appl. No.: 513,478

[22] Filed: Aug. 11, 1995

Related U.S. Application Data

[63] Continuation-in-part of Ser. No. 426,053, Apr. 21, 1995, which is a continuation-in-part of Ser. No. 275,017, Jul. 13, 1994, Pat. No. 5,490,342.

[51] Int. Cl.[6] ..... G09F 21/04

[52] U.S. Cl. ..... 40/587; 301/37.1; 301/37.25

[58] Field of Search ..... 40/587, 495, 591; 301/37.1, 37.25, 37.31, 37.34, 37.36

[56] References Cited

U.S. PATENT DOCUMENTS

| | | | |
|---|---|---|---|
| 1,432,274 | 10/1922 | Braucher | 301/37.25 X |
| 1,478,475 | 12/1923 | Jago et al. | 40/587 |
| 2,014,058 | 9/1935 | Tonai | 40/587 |
| 2,548,070 | 4/1951 | Ryan | 40/587 |
| 2,869,262 | 1/1959 | Lucas | 40/587 |
| 2,954,629 | 10/1960 | Matin | 40/587 |
| 3,707,789 | 1/1973 | Hart | 40/587 |
| 3,769,729 | 11/1973 | Engler | 40/587 |
| 4,678,239 | 7/1987 | Matsushita | 301/37.25 |
| 5,190,354 | 3/1993 | Levy et al. | 40/587 X |
| 5,490,342 | 2/1996 | Ruttermann et al. | 40/587 X |

FOREIGN PATENT DOCUMENTS

| | | | |
|---|---|---|---|
| 1547626 | 12/1969 | Germany | 40/587 |

*Primary Examiner*—Peter M. Cuomo
*Assistant Examiner*—James O. Hansen
*Attorney, Agent, or Firm*—American Innovations, Inc.; Arthur W. Fisher, III

[57] ABSTRACT

A wheel cover for mounting on a wheel comprising a base member having a disc member rotatably mounted thereto to display an indicia thereon, the base member and disc member each includes stabilizing structure configured to mate with each other to maintain concentric alignment and restrict oscillation of the disc member relative to the base member and a counterweight attached to the disc member such that as the base member rotates with the wheel rim the disc member does not rotate relative to the vehicle so that the indicia on the disc member can be viewed as the vehicle translates over the supporting surface.

16 Claims, 13 Drawing Sheets

*Fig. 16*

WHEEL COVER

CROSS REFERENCE

This is a continuation-in-part application of patent application Ser. No. 08/426,053, filed Apr. 21, 1995 which is a continuation-in-part application of patent application Ser. No. 08/275,017, filed Jul. 13, 1994 now U.S. Pat. No. 5,490,342.

BACKGROUND OF THE INVENTION

1. Field of the Invention

A wheel cover mounted on a wheel rim comprising an inner base member having an outer disc member rotatably mounted thereto to display an indicia thereon.

2. Description of the Prior Art

Most vehicles have wheel covers generally adorned with decorative designs or advertising material.

However, since the wheel covers rotate with the vehicle wheels, the designs, symbols and/or advertising slogans and/or information cannot be easily discerned or read.

Efforts have been made to construct stationary wheel covers mounted in such a manner that the wheel covers remain in a stationary, non-rotating position while the wheels and hub caps of the vehicle rotate are known to the art. Such covers permit inscriptions, names, monograms, designs and the like, to be attached or inscribed on their outer surface to be readily visible and to remain in a stationary upright position, notwithstanding the rotation of the wheels and hub caps of the vehicle. Often such wheel covers lack stability and tend to oscillate about the axis of rotation of the hub caps on which the assemblies are mounted.

U.S. Pat. No. 5,190,354 describes a wheel cover comprising a rotatable shield element for rotation to maintain a fixed angular position relative to the horizontal even during rotation of the wheel. There is a connection between the securement and support device and the shield element comprising a roller bearing mounted on the support shaft by an annular intermediate member disposed adjustably between an internal ring of the roller bearing and the support shaft, and delimited by a perforated disk, whose diameter corresponds to that of the internal ring.

U.S. Pat. No. 4,929,030 shows a hub cap having at its center a static lateral axis, a supporting plate fixed to the inner side of the hub cap and a clutch plate fixed at one of its ends to the inner end of the lateral axle. The clutch plate includes an eccentric bob fixed at its other end. A static member is fixed to the outer end of the lateral axis and having a second eccentric bob connected thereto. A rear cover is connected to the inner side of the hub cap and covers the support plate and clutch plate.

U.S. Pat. No. 4,280,293 teaches a stationary display member mounted on the rotating hub cap comprising a disc-like member coaxially mounted on the hub cap to be freely rotatable about the axis of rotation of the hub cap. The disc-like member has an internal chamber which is partially filled with a flowable material that collects at the bottom of the chamber to form an off-set weight which prevents the disc-like member from turning as the hub cap turns about its axis of rotation. A damping device included in the chamber coacts with the flowable material to dampen any tendency for the disc-like member to oscillate about the axis of rotation of the hub cap. An appropriate insignia, design, message or other inscription is imprinted or attached to the outer face of the disc-like member and remains stationary as the hub cap rotates.

German (DE) 3,919,268 describes a hubcap consisting of an inner member having means both to attach the hubcap to a wheel and to support a rotatable outer member. The outer member is fitted at one edge with a weight that helps prevent, the outer member rotating with the inner member.

U.S. Pat. No. 1,478,475 shows an advertising device for vehicles comprising a cap adapted to be screwed on to the wheel-hub, a spindle and a ball bearing supporting the spindle in the cap. A portion of the inner part of the ball bearing forms a shoulder with the spindle.

U.S. Pat. No. 2,014,058 teaches a hubcap comprising a body having a concavity in the face to provide an inner wall, a hub secured to the inner wall, a name plate closing the concavity, a shaft secured to the name plate and mounted for rotation in the hub and means to normally hold the name plate stationary when the wheel is in motion.

U.S. Pat. No. 3,769,729 describes a display apparatus including a main plate of a diameter such that its peripheral edge portion is abuttingly secured to a vehicle wheel rim and on which is rotatably mounted a display disk held by a counterweight against rotation where the wheel is rotating, and a transparent cover for the disk whose edge flange is separably secured to the peripheral edge portion of the main plate.

British (GB) 281,602 shows the arrangement of non-rotating discs fixed to non-rotating axles on the outer side of wheels of vehicles for the display of advertising.

Great Britain 1,188,397 teaches an advertising display attachment for use with a vehicle wheel assembly comprising a non-rotatable axle having a threaded end, a hub rotatably mounted on the axle and a nut engaging the threaded axle end to maintain the hub on the axle. The advertising display attachment comprises a support member having an end wall and a peripheral side wall disposed substantially perpendicular to the end wall and adapted to receive the nut. A stepped annular backing member is adapted for mounting on the axle between the nut and the hub; while, an annular sealing element is adapted to be disposed between the backing member and the hub. A securing means is provided at the end wall of the support member adapted to carry an advertising display plate. The arrangement being such that in the assembled configuration on the wheel assembly, the support member and backing member enclose the nut and the hub is still capable of rotation on the axle and with respect to the support and backing member.

U.S. Pat. No. 1,432,274 shows another example of an advertising disk for automobile wheels.

SUMMARY OF THE INVENTION

The present invention relates to a wheel cover for mounting on a wheel comprising a base member having a disc member rotatably mounted thereto. The base member and disc member are obversely configured to mate with each other to maintain concentric alignment and limit oscillation of the disc member relative to the base member.

The base member comprises an inner base element and an outer base element attached to the rim by a plurality of legs. The inner base element comprises a base including a base hub and a base tongue extending outwardly therefrom and disposed in spaced relationship relative to the base hub to cooperatively form a substantially circular base groove therebetween. The outer base element comprises an annular plate extending between the outer periphery of the base and the outer base element comprising a substantially Z-shaped cross-section including an inner member and an outer member held in substantially parallel spaced relationship relative to each other by an inclined interconnecting member having an inclined base surface. The base tongue and inclined interconnecting member cooperatively form a base channel therebetween.

The disc member comprises a disc element including a flat outer surface on which indicia or designs are formed, a disc hub having a counter-sunk recess formed therein to receive and retain a disc mounting element therein, a disc tongue extending outwardly from the disc member and disposed in spaced relationship relative to the disc hub to cooperatively form a hub alignment recess therebetween. A disc ridge is formed in spaced relationship relative to the disc tongue to cooperatively form a disc groove therebetween.

The peripheral edge of the disc element comprises an inclined disc surface. A plurality of recesses are formed in the disc tongue to house a corresponding plurality of weights to collectively form a means to limit or restrict rotation of the substantially circular disc member.

When assembled, the base hub is disposed within the hub alignment recess, the disc tongue is disposed within the base groove, the base tongue is disposed within the disc groove and the disc ridge is disposed within the base channel within the inclined base surface disposed immediately adjacent the inclined disc surface. So configured and assembled, these corresponding structural elements are operatively disposed relative to each other to limit the oscillation of the base member relative to the disc member to stabilize and limit lateral movement of the disc member relative to the base member.

In use, an appropriate inscription is formed on the flat outer surface of the disc member. When the tire and wheel rotate, the disc member remains rotationally stationary, not rotating with the wheel. This is because the weights retain the disc member substantially upright.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

As shown in FIGS. 1 through 4, the present invention relates to a wheel cover generally indicated as 10 for mounting on a wheel 12 configured to mount a tire 14 to an axle 16 operatively coupled to a vehicle generally indicated as 18.

Figure 1:
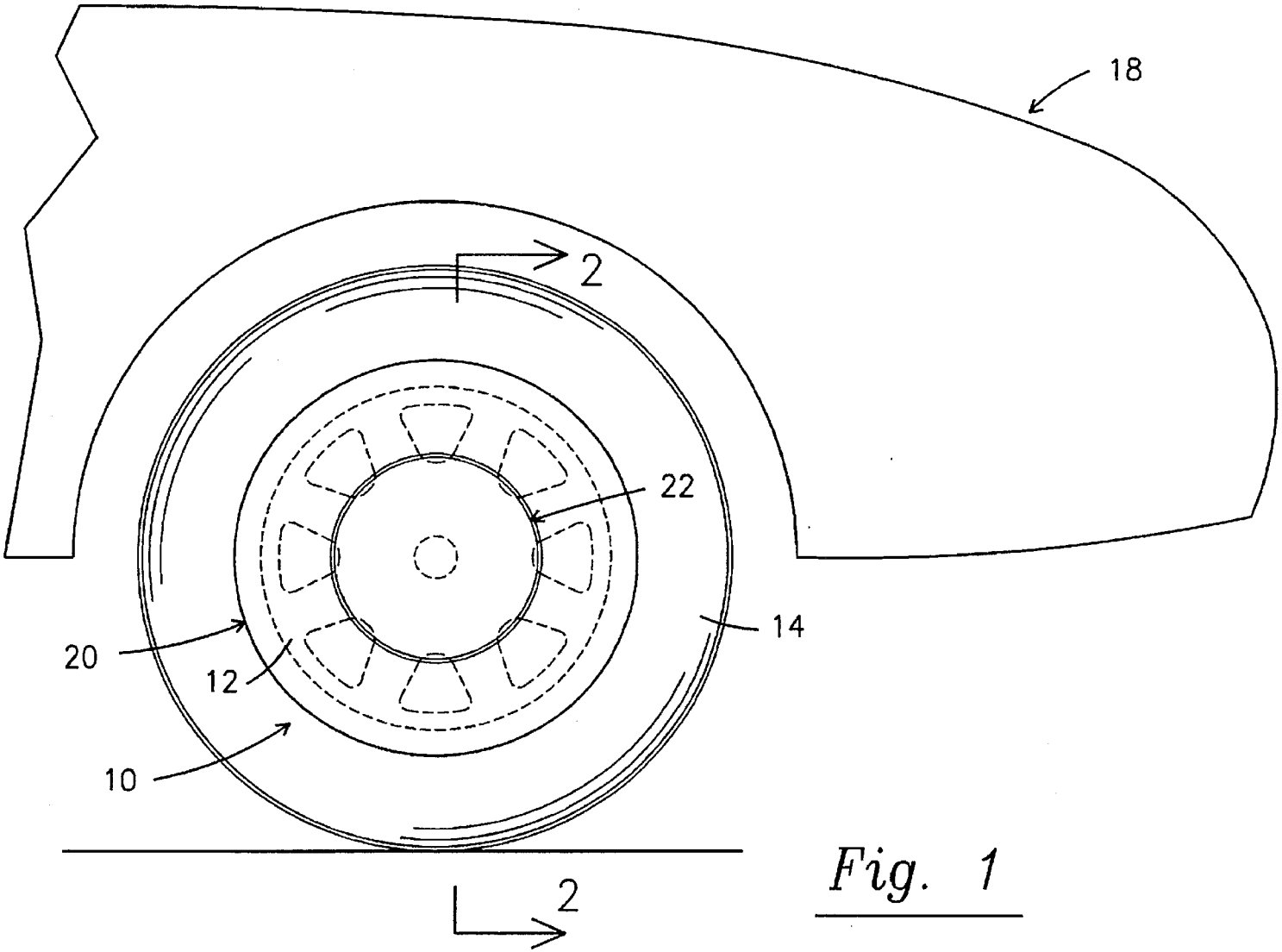
FIG. 1 is a front view of a wheel cover mounted on a wheel.
Figure 2:
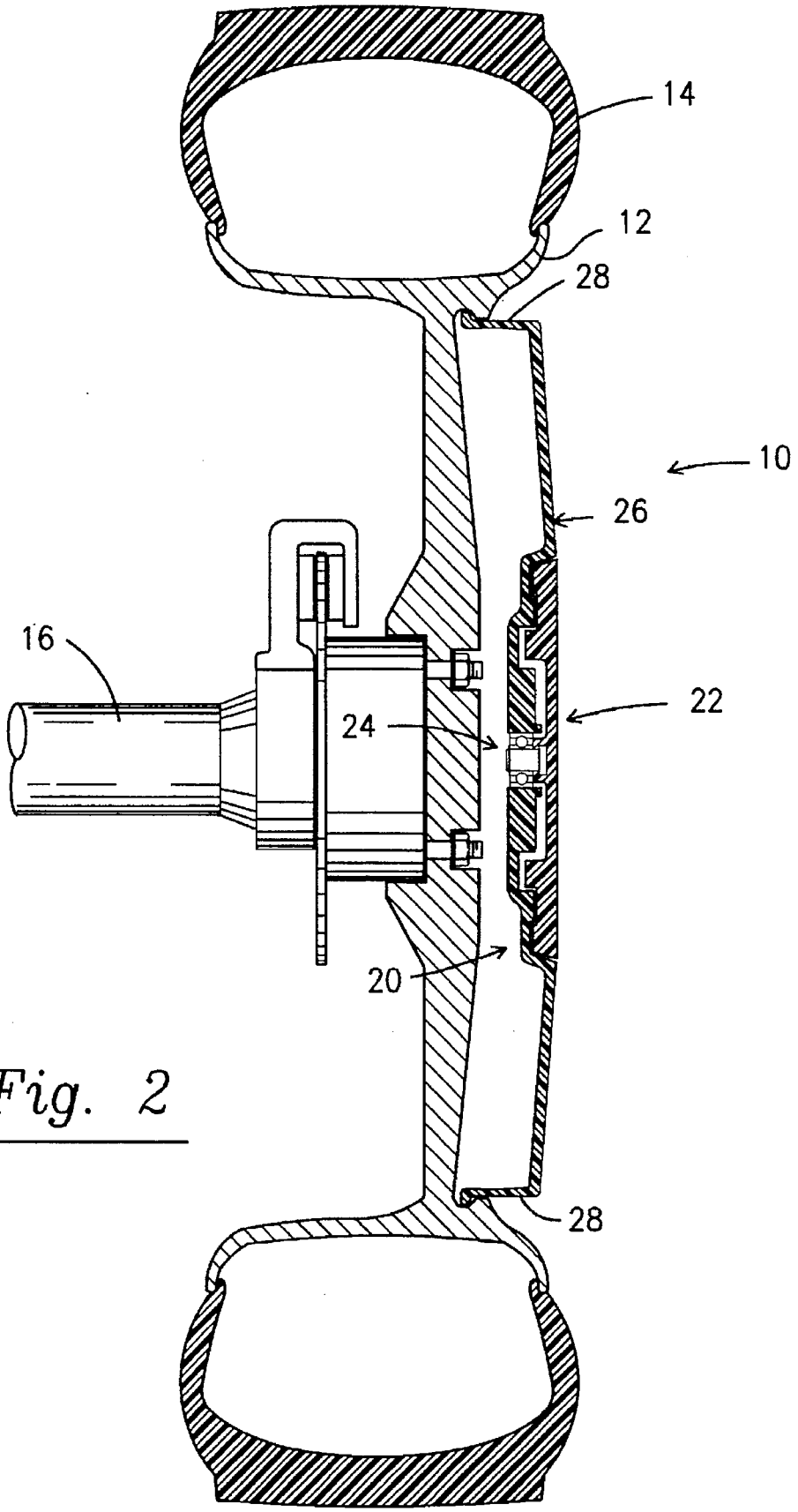
FIG. 2 is a cross-sectional side view of the wheel cover mounted on a wheel taken along line 2—2 of FIG. 1.
Figure 3:
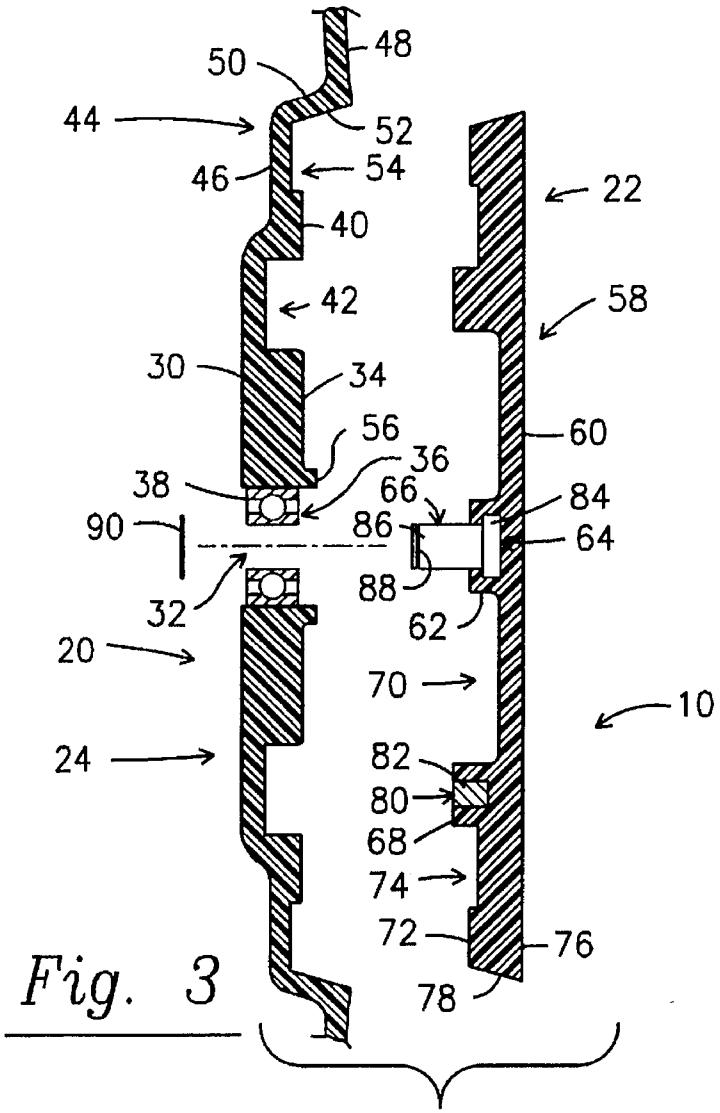
FIG. 3 is an exploded cross-sectional side view of the wheel cover shown in FIG. 1.

As best shown in FIGS. 1 through 3, the wheel cover 10 comprises a substantially circular base member generally indicated as 20 having a substantially circular disc member generally indicated as 22 mounted thereto.

As described more fully hereinafter, the substantially circular base member 20 and the substantially circular disc member 22 are obversely configured to mate with each other to maintain concentric alignment and limit oscillation of the substantially circular disc member 22 relative to the substantially circular base member 20.

As best shown in FIG. 2, the substantially circular base member 20 comprises an inner base element generally indicated as 24 configured to operatively receive and support the substantially circular disc member 22 thereon as described more fully hereinafter and an outer base element generally indicated as 26 attached to the wheel 12 by a plurality of attachment means or legs each indicated as 28.

As best shown in FIG. 3, the inner base element 24 comprises a substantially circular base 30 including a substantially cylindrical base hub 34 having a centrally disposed aperture 36 formed therethrough to operatively receive and house a bearing 38 with a channel 32 therein and a substantially circular base tongue 40 extending outwardly from the substantially cylindrical base 30 and disposed in spaced relationship relative to the substantially cylindrical base hub 34 to cooperatively form a substantially circular base groove 42 therebetween.

As shown in FIGS. 2 and 3, the outer base element 26 comprises a substantially annular plate generally indicated as 44 extending between the outer periphery of the substantially circular base 30 and the attachment means or legs 28. The substantially annular plate 44 comprises a substantially Z-shaped cross-section including an inner member 46 and an outer member 48 held in substantially parallel spaced relationship relative to each other by an inclined interconnecting member 50 having an inclined base surface 52. The substantially circular base tongue 40 and inclined interconnecting member 50 cooperatively form a substantially circular base channel 54 therebetween.

As best shown in FIG. 3, an annular limit rim 56 extends outwardly from the surface of the substantially cylindrical base hub 34 adjacent the centrally disposed aperture 36.

Figure 4:
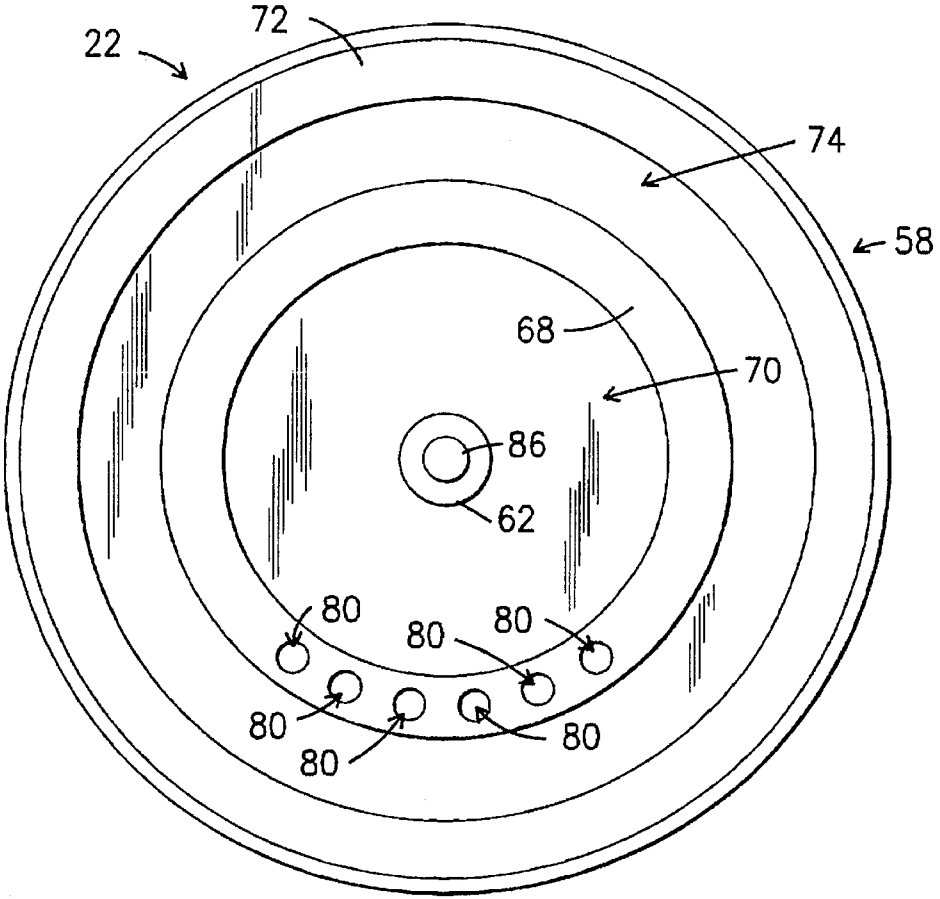
FIG. 4 is a rear view of the disc member of the wheel cover shown in FIG. 1.

As shown in FIGS. 3 and 4, the substantially circular disc member 22 comprises a substantially circular disc element generally indicated as 58 including a flat outer surface 60 on which indicia or designs are formed, a substantially cylindrical disc hub 62 having a counter-sunk recess 64 formed therein to receive and retain a disc mounting element generally indicated as 66 therein, a substantially circular disc tongue 68 extending outwardly from the substantially circular disc member 22 and disposed in spaced relationship relative to the substantially cylindrical disc hub 62 to cooperatively form a substantially circular hub alignment recess 70 therebetween. A substantially circular disc ridge 72 is formed in spaced relationship relative to the substantially circular disc tongue 68 to cooperatively form a substantially circular disc groove 74 therebetween. The peripheral edge 76 of the substantially circular disc element 58 comprises an inclined disc surface 78.

As shown in FIGS. 3 and 4, a plurality of recesses each indicated as 80 are formed in the substantially circular disc tongue 68 to house a corresponding plurality of weights each indicated as 82 to collectively form a means to limit or restrict rotation of the substantially circular disc member 22.

As best shown in FIG. 3, the disc mounting element 66 comprises an enlarged retainer end 84 disposed within the counter-sunk recess 64 having an elongated disc mounting member 86 extending outwardly therefrom to pass through the channel 32. The substantially circular disc member 22 is retained on the substantially circular base member 20 by the engagement of a lock recess or groove 88 formed on the end portion of the elongated disc mounting member 86 and a lock ring 90.

As previously set forth, the substantially circular base member 20 and the substantially circular disc member 22 are obversely configured to mate with each other to maintain concentric alignment and limit oscillation of the substantially circular disc member 22 relative to the substantially circular base member 20.

Specifically, when assembled, as best shown in FIGS. 2 and 3, the substantially cylindrical base hub 34 is disposed within the substantially circular hub alignment recess 70 with the annular limit rim 56 immediately adjacent the substantially cylindrical disc hub 62, the substantially circular disc tongue 68 is disposed within the substantially circular base groove 42, the substantially circular base tongue 40 is disposed within the substantially circular disc groove 74 and the substantially circular disc ridge 72 is disposed within the substantially circular base channel 54 within the inclined base surface 52 disposed immediately adjacent the inclined disc surface 78. So configured and assembled, the annular limit rim 56 and the substantially cylindrical disc hub 62, the substantially cylindrical base hub 34 and the substantially circular hub alignment recess 70, the substantially circular disc tongue 68 and the substantially circular base groove 42, the substantially circular base tongue 40 and the substantially circular groove 74, the substantially circular ridge and the substantially circular channel 54, and the inclined base surface 52 and the inclined disc surface 78 are operatively disposed relative to each other to limit the oscillation of the substantially circular base member 20 relative to the substantially circular disc member 22 to stabilize and limit lateral movement of the substantially circular disc member 22 relative to the substantially circular base member 20.

In use, an appropriate inscription is formed on the flat outer surface 60 of the substantially circular disc member 22. When the tire 14 and wheel 12 mounted on the axle 16 rotate, the substantially circular disc member 22 remains rotationally stationary, not rotating with the wheel 12. This is because the weights 82 retain the substantially circular disc member 22 substantially upright with the disc mounting element 66 disposed within the bearing 38.

FIGS. 5 through 9 show an alternate embodiment of a wheel cover generally indicated as 110 for mounting on a wheel generally indicated as 112 configured to mount a tire 114 to an axle 116 operatively coupled to a vehicle generally indicated as 118.

Figure 6:
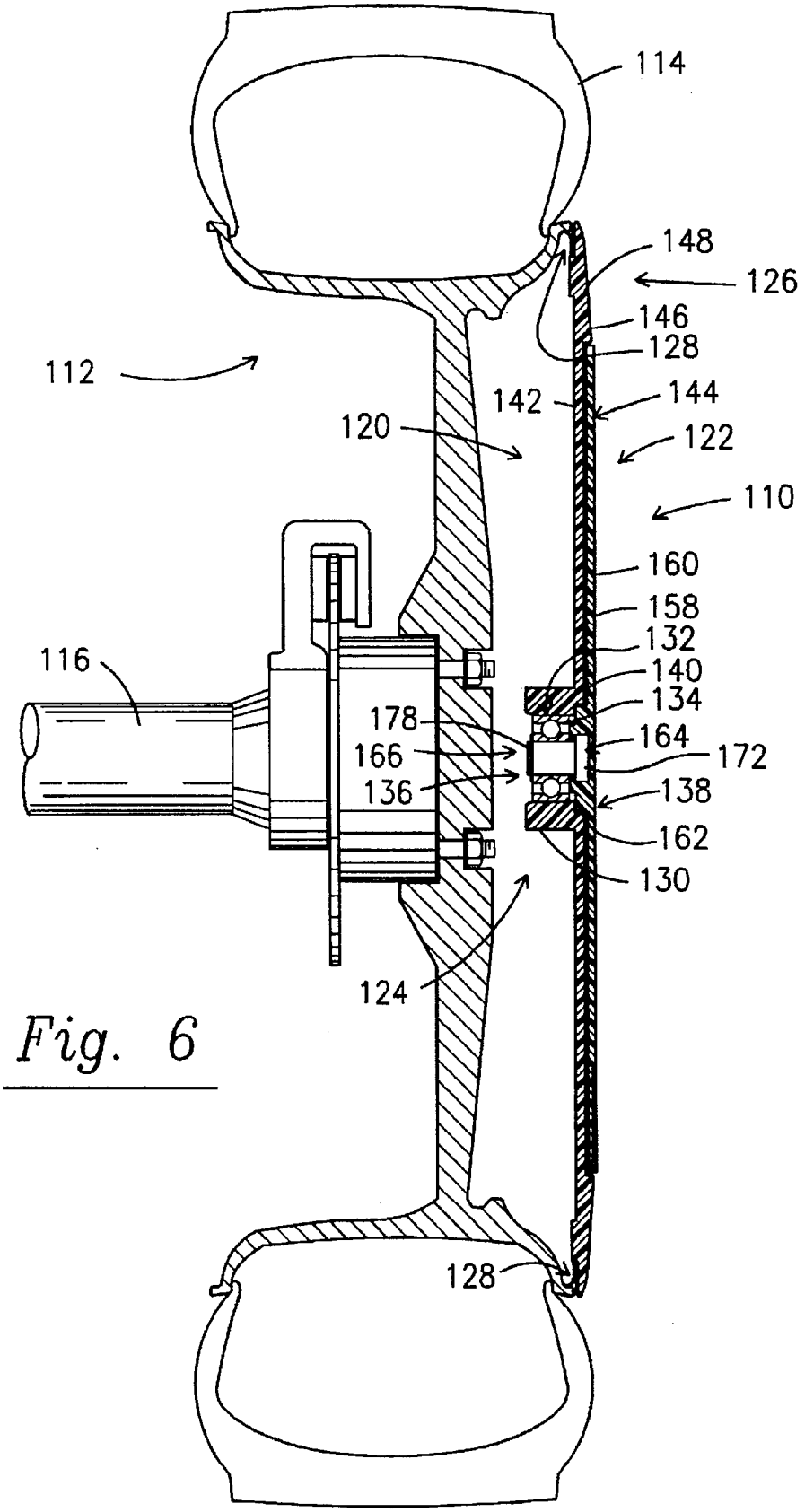
FIG. 6 is a cross-sectional side view of wheel cover mounted on a wheel taken along line 6—6 of FIG. 5.
Figure 7:
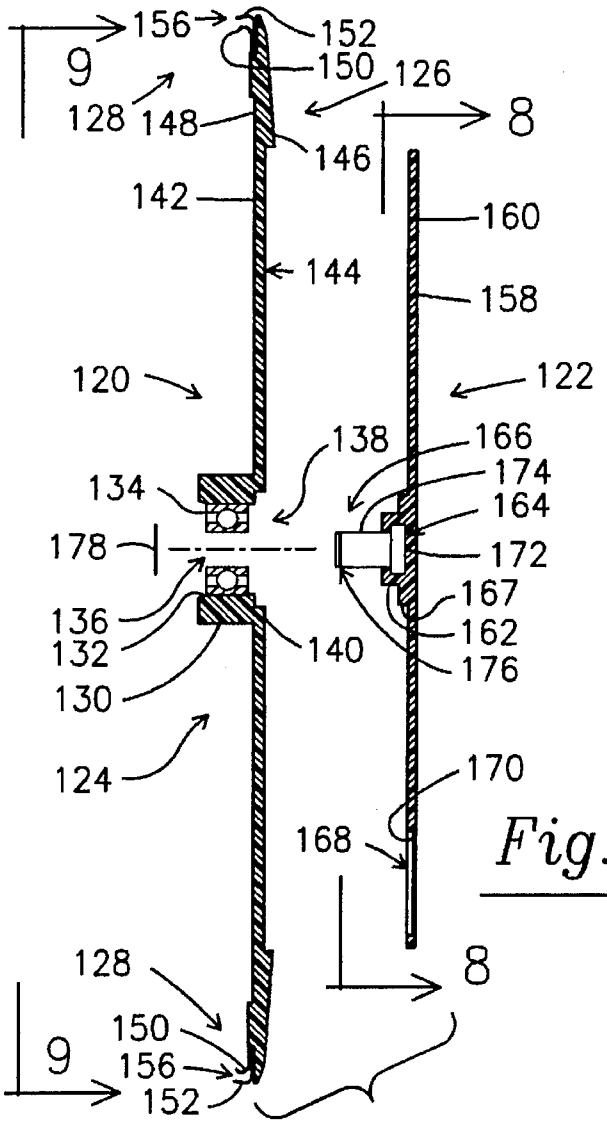
FIG. 7 is an exploded side view of the wheel cover shown in FIG. 5.
Figure 5:
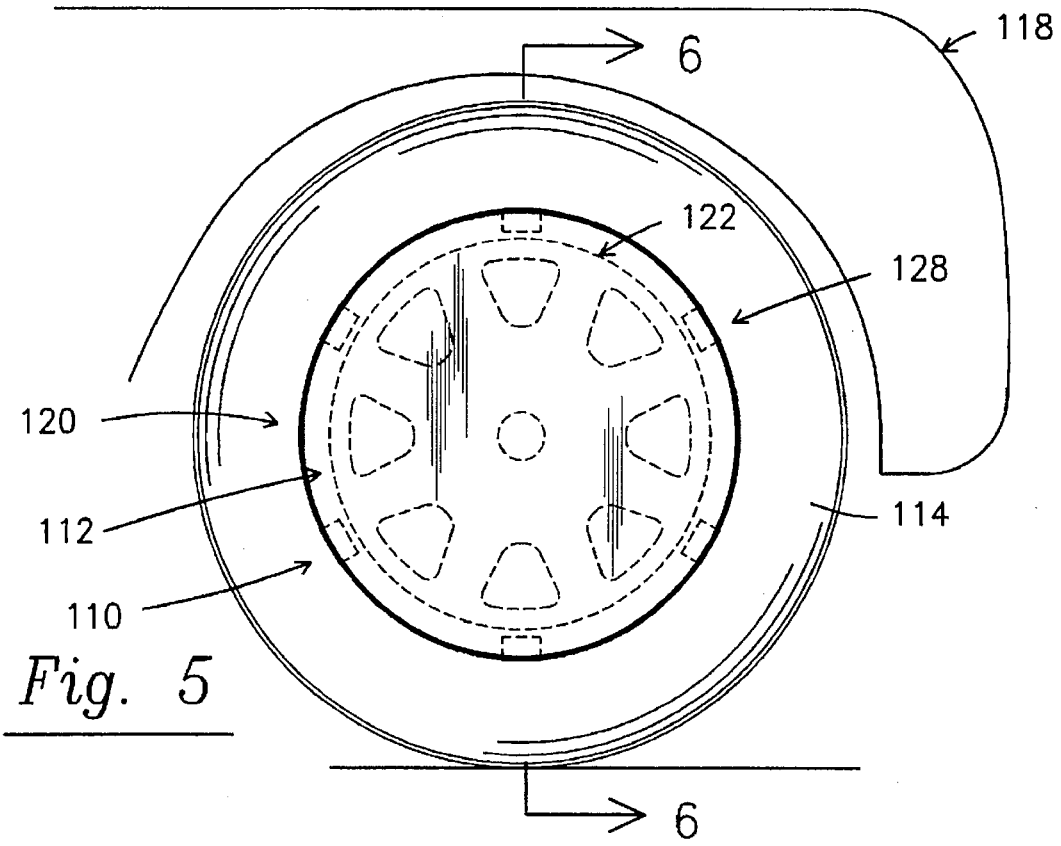
FIG. 5 is a front view of an alternate embodiment of a wheel cover mounted on a wheel.

As best shown in FIGS. 5 through 7, the wheel cover 110 comprises a substantially circular base member generally indicated as 120 having a substantially circular disc member generally indicated as 122 mounted thereto.

As described more fully hereinafter, the substantially circular base member 120 and the substantially circular disc member 122 are configured to mate with each other to maintain concentric alignment and limit oscillation of the substantially circular disc member 122 relative to the substantially circular base member 120.

Figure 9:
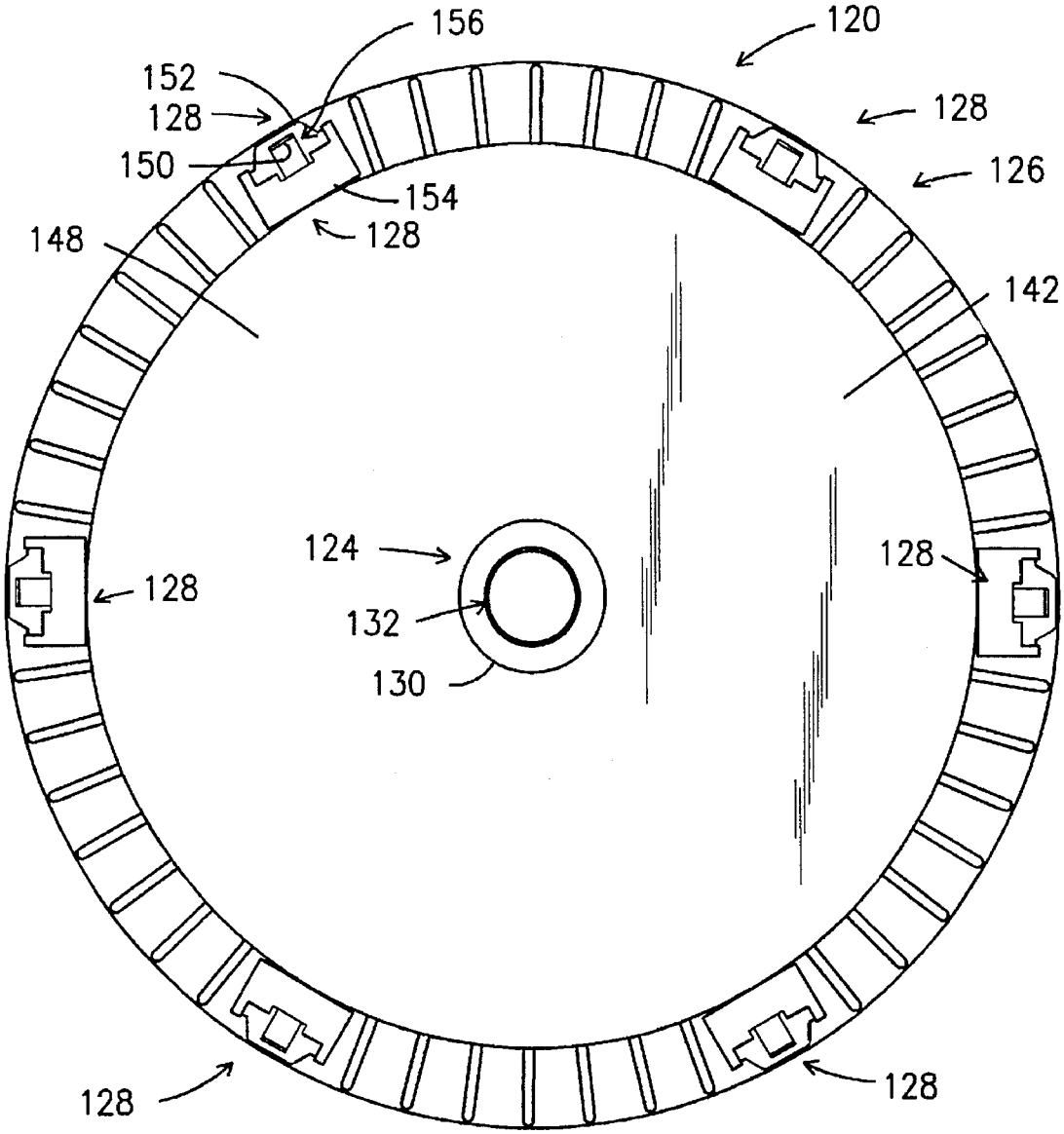
FIG. 9 is a rear view of the base member of the wheel cover shown in FIG. 5.

As best shown in FIGS. 6, 7 and 9, the substantially circular base member 120 comprises an inner base element generally indicated as 124 configured to operatively receive and support the substantially circular disc member 122 thereon as described more fully hereinafter and an outer base element generally indicated as 126 attached to the wheel 112 by a plurality of attachment means each indicated as 128.

As best shown in FIGS. 6, 7 and 9, the inner base element 124 comprises a substantially cylindrical base hub 130 having a centrally disposed aperture 132 formed therethrough to operatively receive and house a bearing 134 with a channel 136 therein and a concentrically disposed substantially recess 138 formed in the outer face or surface 140 thereof to receive a portion of the substantially circular disc member 122 as described more fully hereinafter.

As best shown in FIGS. 6, 7 and 9, the outer base element 126 comprises a substantially annular plate generally indicated as 142 having a recess 144 formed in the outer face or surface 146 thereof to receive a portion of the substantially circular disc member 122 therein as described more fully hereinafter. The inner surface of the outer periphery 148 of the substantially annular plate 142 supports or receives each of the plurality of the attachment means 128.

As best shown in FIGS. 7 and 9, each of the attachment means 128 comprises a first and second flexible element indicated as 150 and 152 respectively extending outwardly from a base member 154 affixed to the inner surface of the outer periphery 148 of the substantially annular plate 142 to cooperatively form a space 156 therebetween to press fit over the rim for the wheel 112 as best shown in FIG. 6 to secure the wheel cover 110 thereto.

Figure 8:
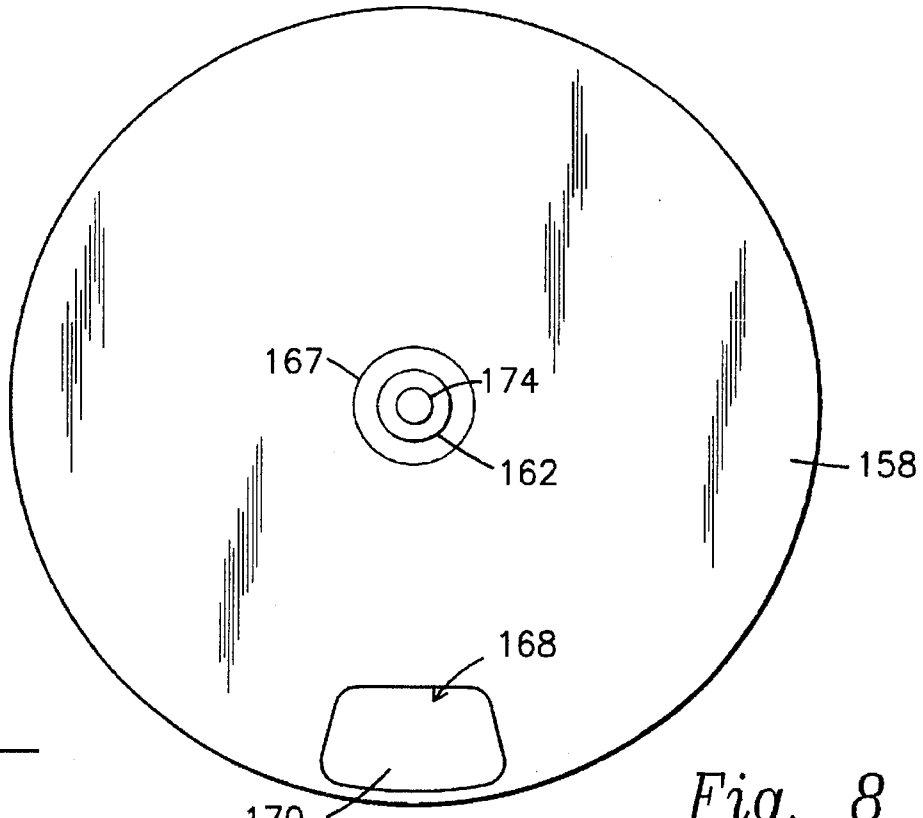
FIG. 8 is a front view of the disc member of the wheel cover shown in FIG. 5.

As best shown in FIGS. 6 through 8, the substantially circular disc member 122 comprises a substantially circular disc element 158 including a flat outer surface 160 on which indicia or designs are formed, a substantially cylindrical disc hub 162 having a counter-sunk recess 164 formed therein to receive and retain a disc mounting element generally indicated as 166 therein. An annular alignment disc element 167 may be fused at the base of the substantially cylindrical disc hub 162.

As best shown in FIGS. 6 through 8, at least one recess 168 is formed in the substantially circular disc element 158 to house a weight 170 to form a means to limit or restrict rotation of the substantially circular disc member 122.

As best shown in FIGS. 6 and 7, the disc mounting element 166 comprises an enlarged retainer end 172 disposed within the counter-sunk recess 164 having an elongated disc mounting member 174 extending outwardly therefrom to pass through the channel 136. The substantially circular disc member 122 is retained on the substantially circular base member 120 by the engagement of a lock recess or groove 176 formed on the end portion of the elongated disc mounting member 174 and a lock ring 178.

As previously set forth, the substantially circular base member 120 and the substantially circular disc member 122 are obversely configured to mate with each other to maintain concentric alignment and limit oscillation of the substantially circular disc member 122 relative to the substantially circular base member 120.

Specifically, when assembled, as best shown in FIGS. 6 and 7, the substantially cylindrical disc hub 162 is disposed within the recess 138; while, the substantially circular disc element 158 is disposed within the recess 144.

In use, an appropriate inscription is formed on the flat outer surface 160 of the substantially circular disc member 122. When the tire 114 and wheel 112 mounted on the axle 116 rotate, the substantially circular disc member 122 remains rotationally stationary, not rotating with the wheel 112. This is because the weight 168 retains the substantially circular disc member 122 upright with the disc mounting element 166 disposed within the bearing 134.

Figure 10:
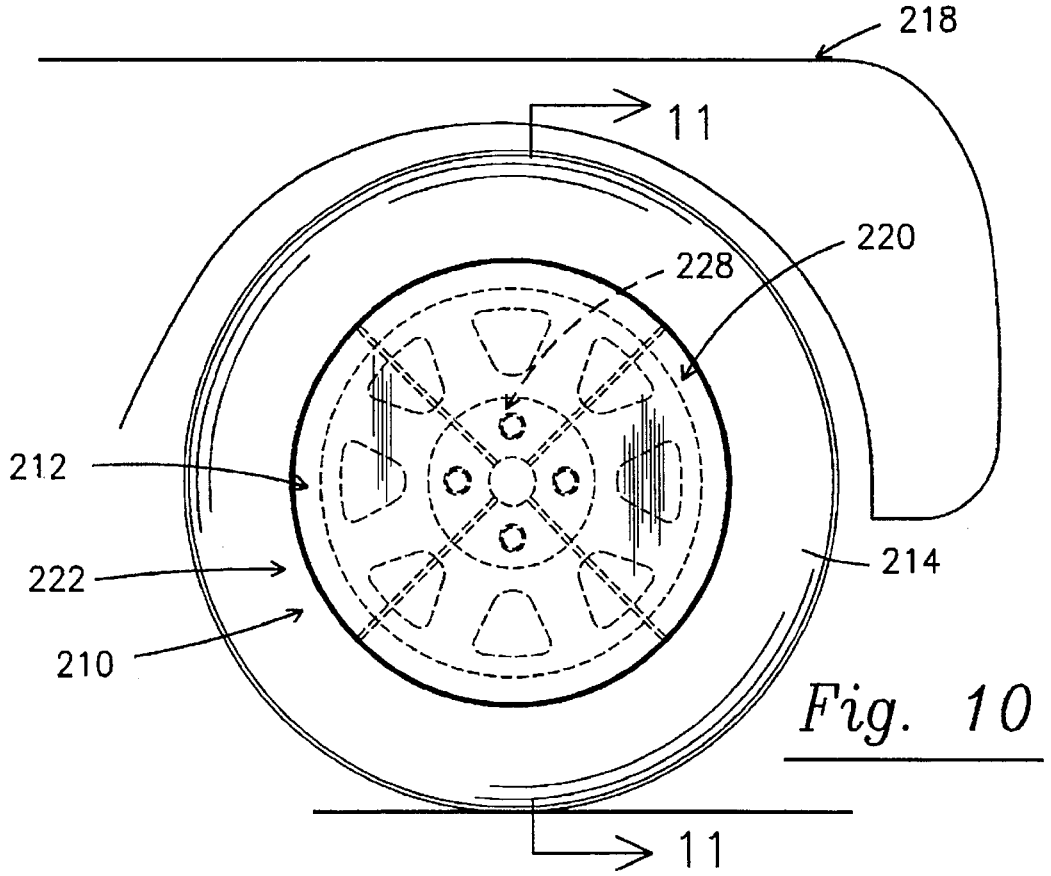
FIG. 10 is a front view of another alternate embodiment of a wheel cover mounted on a wheel.
Figure 11:
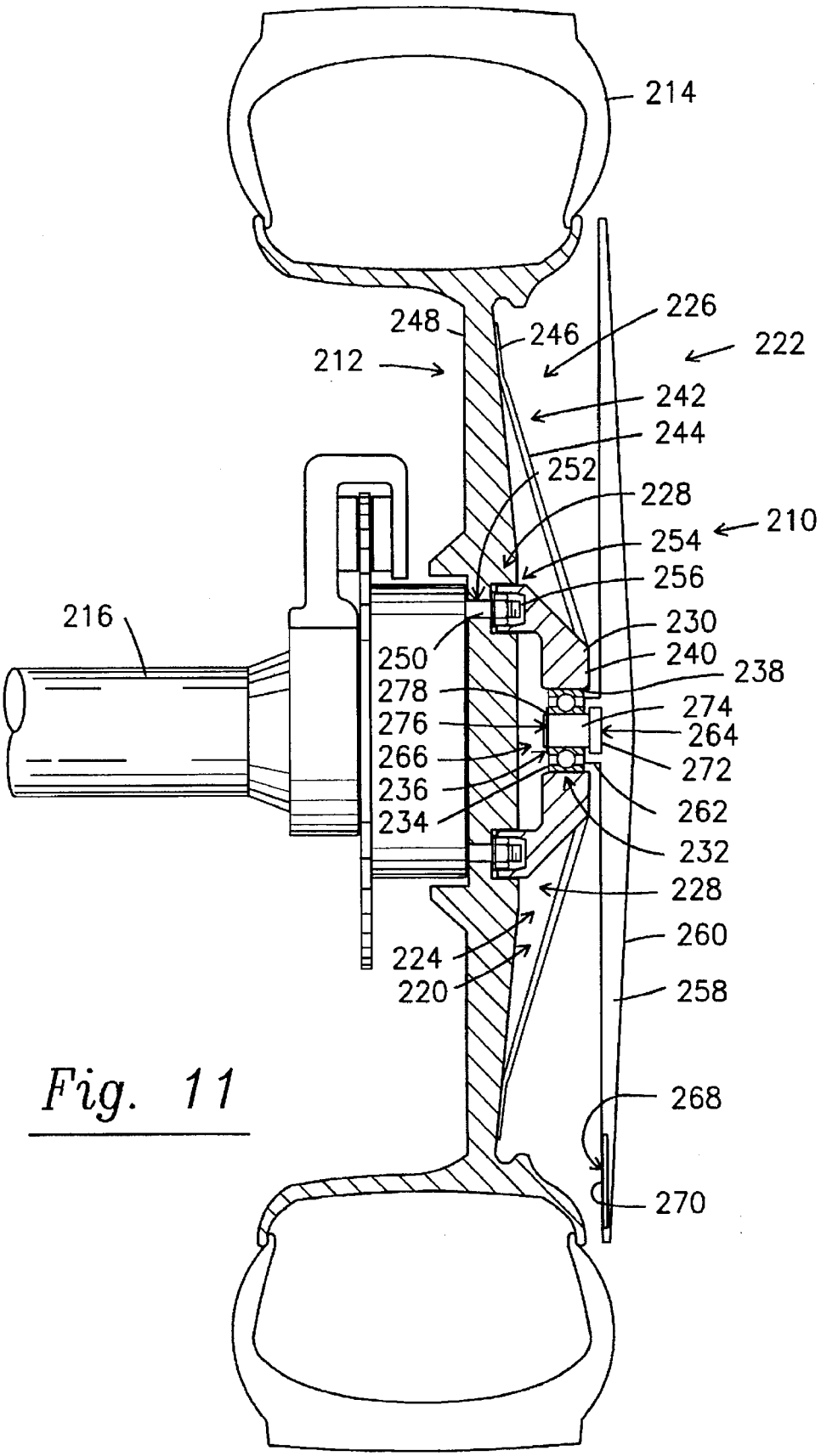
FIG. 11 is a cross-sectional side view of the wheel cover mounted on a wheel taken along line 11—11 of FIG. 10.

FIGS. 10 and 11 show another alternate embodiment of a wheel cover generally indicated as 210 for mounting on a wheel generally indicated as 212 configured to mount a tire 214 to an axle 216 operatively coupled to a vehicle generally indicated as 218.

As shown in FIGS. 10 and 11, the wheel cover 210 comprises a substantially circular base member generally indicated as 220 having a substantially circular disc member generally indicated as 222 rotatably mounted thereto.

As described more fully hereinafter, the substantially circular base member 220 and the substantially circular disc member 222 are configured to mate with each other to maintain concentric alignment and limit oscillation of the substantially circular disc member 222 relative to the substantially circular base member 220.

As best shown in FIG. 11, the substantially circular base member 220 comprises an inner base element generally indicated as 224 configured to operatively receive and support the substantially circular disc member 222 thereon as described more fully hereinafter and an outer base element generally indicated as 226 attached to the wheel 212 by a plurality of attachments each indicated as 228.

As best shown in FIG. 11, the inner base element 224 comprises a substantially cylindrical base hub 230 having a centrally disposed aperture 232 formed therethrough to operatively receive and house a bearing 234 with a channel 236 therein and a concentrically disposed recess 238 formed in the outer face or surface 240 thereof to receive a portion of the substantially circular disc member 222 as described more fully hereinafter.

As best shown in FIG. 11, the outer base element 226 comprises a substantially annular plate generally indicated as 242 extending between the substantially cylindrical hub 230 and a portion of the wheel 212. The substantially annular plate 242 comprises an inner member 244 inclined relative to the substantially cylindrical hub 230 and an outer member 246 substantially parallel to and engaging the outer surface of the wheel base 248.

As best shown in FIG. 11, each of the attachment means 228 comprises an elongated externally threaded member 250 extending through corresponding a channel 252 formed through the wheel base 248 and a corresponding aperture 254 formed in the substantially cylindrical hub 230 to secure the wheel cover 210 to the wheel 212 with a corresponding nut or fastening means 256.

As best shown in FIG. 11, the substantially circular disc member 222 comprises a substantially circular disc element 258 including an outer surface 260 on which indicia or designs are formed, a substantially cylindrical disc hub 262 having a counter-sunk recess 264 formed therein to receive and retain a disc mounting element generally indicated as 266 therein.

As best shown in FIG. 11, at least one recess 268 is formed in the substantially circular disc element 258 to house a weight 270 to form a means to limit or restrict rotation of the substantially circular disc member 222.

As best shown in FIG. 11, the disc mounting element 266 comprises an enlarged retainer end 272 disposed within the counter-sunk recess 264 having an elongated disc mounting member 274 extending outwardly therefrom to pass through the channel 236. The substantially circular disc member 222 is retained on the substantially circular base member 220 by the engagement of a lock recess or groove 276 formed on the end portion of the elongated disc mounting member 274 and lock ring 278.

As previously set forth, the substantially circular base member 220 and the substantially circular disc member 222 are obversely configured to mate with each other to maintain concentric alignment and limit oscillation of the substantially circular disc member 222 relative to the substantially circular base member 220. Specifically, when assembled, as best shown in FIG. 11, the substantially cylindrical disc hub 262 is disposed within the recess 238.

In use, an appropriate inscription is formed on the outer surface 260 of the substantially circular disc member 222. When the tire 214 and wheel 212 mounted on the axle 216 rotate, the substantially circular disc member 222 remains rotationally stationary, not rotating with the wheel 212. This is because the weight 268 retains the substantially circular disc member 222 substantially upright with the disc mounting element 266 disposed within the bearing 234.

Figure 13:
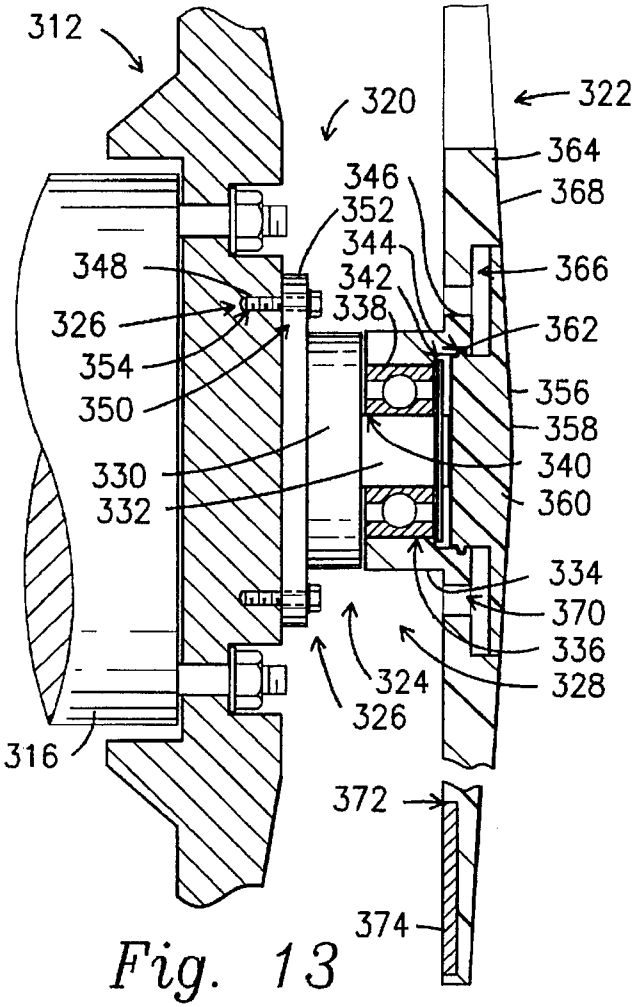
FIG. 13 is a cross-sectional side view of the wheel cover mounted on a wheel taken along line 13-13 of FIG. 12.
Figure 12:
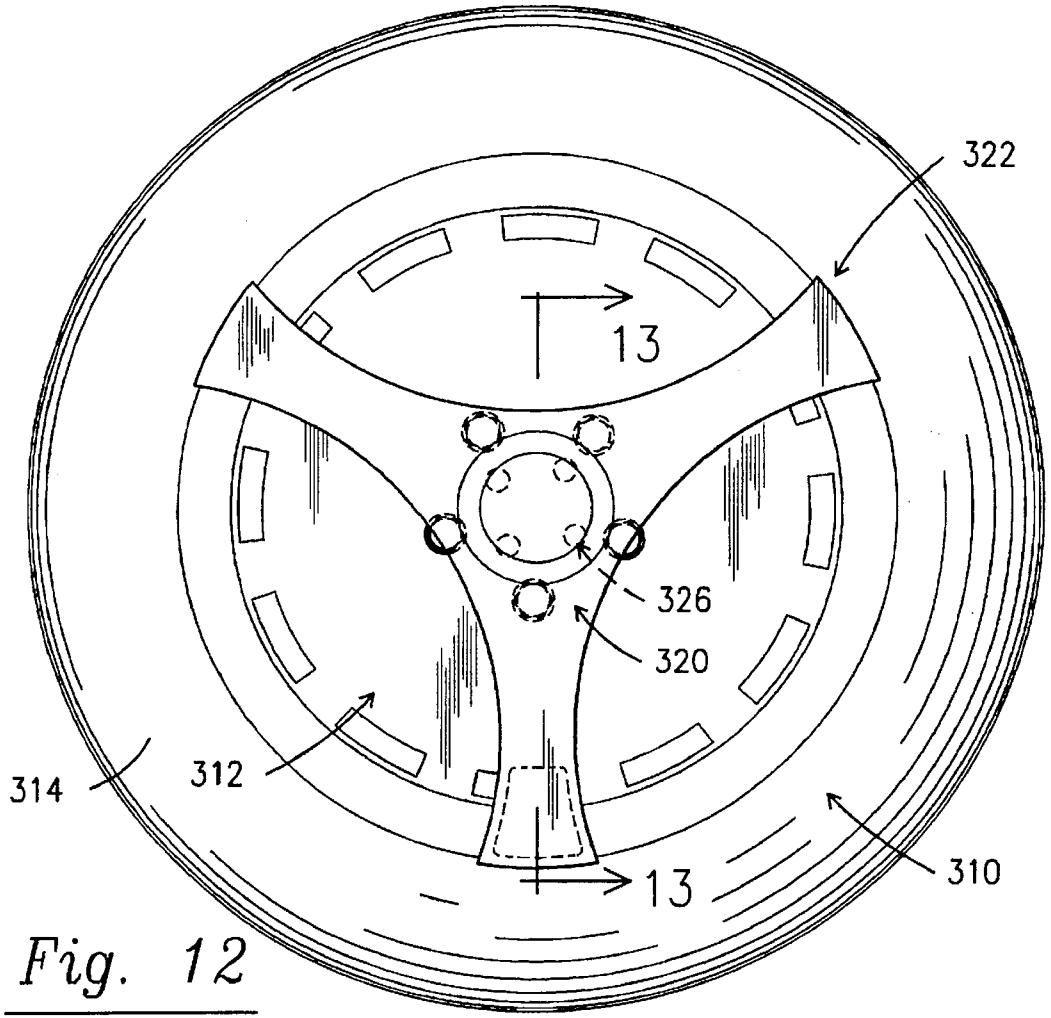
FIG. 12 is a front view of yet another alternate embodiment of a wheel cover mounted on a wheel.

FIGS. 12 and 13 show yet another alternate embodiment of a wheel cover generally indicated as 310 for mounting on a wheel generally indicated as 312 configured to mount a tire 314 to an axle 316 operatively coupled to a vehicle generally indicated as 318.

As shown in FIGS. 12 and 13, the wheel cover 310 comprises a base member generally indicated as 320 having a disc member generally indicated as 322 mounted thereto.

As described more fully hereinafter, the base member 320 and the disc member 322 are configured to mate with each other to maintain concentric alignment and limit oscillation of the disc member 322 relative to the base member 320.

As best shown in FIG. 13, the base member 320 comprises an inner base element generally indicated as 324 attached to the wheel 312 by a plurality of attachments each generally indicated as 326 and an outer base element generally indicated as 328 configured to operatively receive and support the disc member 322 thereon as described more fully hereinafter.

As best shown in FIG. 13, the inner base element 324 comprises a substantially cylindrical base hub 330 having a centrally disposed protrusion 332 formed therethrough to operatively receive and support the outer base element 328 thereon.

As best shown in FIG. 13, the outer base element 328 comprises a substantially cylindrical member 334 having a centrally disposed aperture 336 formed therethrough to operatively receive and house a bearing 338 with a channel 340 therein to receive the centrally disposed protrusion 332 therein and a concentrically disposed recess 342 formed in the outer portion having a groove 344 formed in the periphery thereof to receive a portion of the disc member 332 as described more fully hereinafter. The outer base member 328 further includes an enlarged annular rim 346 formed on the outer end of the substantially cylindrical member 334.

As best shown in FIG. 13, each of the attachment means 326 comprises an elongated externally threaded member 348 extending through corresponding a channel 350 formed through the base 352 of the substantially cylindrical base hub 330 to secure the wheel cover 310 to the wheel 312.

As best shown in FIG. 13, the disc member 322 comprises an inner circular disc element 356 including an outer surface 358 on which indicia or designs are formed, a substantially cylindrical disc hub 360 having a tongue or ridge 362 formed thereon to be received and retained in the groove 344 and an outer disc element 364 having a recess 366 formed on the outer surface 368 thereof and a plurality of access apertures each indicated as 370 formed therethrough.

As best shown in FIG. 13, at least one recess 372 is formed in the outer disc element 364 to house a weight 374 to form a means to limit or restrict rotation of the disc member 322.

As previously set forth, the base member 320 and the disc member 322 are configured to mate with each other to maintain concentric alignment and limit oscillation of the substantially circular disc member 322 relative to the substantially circular base member 320 specifically, when assembled, as best shown in FIG. 13, the substantially cylindrical protrusion 332 is disposed within the channel 340 which is disposed within the centrally disposed aperture 336.

In use, an appropriate inscription is formed on the outer surface of the disc member 322. When the tire 314 and wheel 312 mounted on the axle 316 rotate, the disc member 322 remains rotationally stationary, not rotating with the wheel 312. This is because the weight 374 retains the disc member 322 substantially upright with the bearing 338 operatively disposed between the centrally disposed protrusion 332 and the substantially cylindrical member 334.

FIGS. 14 through 19 show still another alternate embodiment of a wheel cover generally indicated as 410 for mounting on a wheel generally indicated as 412 configured to mount a tire 414 on an axle 416 operatively coupled to a vehicle generally indicated as 418.

As best shown in FIGS. 14 through 17, the wheel cover 410 comprises a substantially circular base member generally indicated as 420 having a substantially circular disc member generally indicated as 422 mounted thereto.

As described more fully hereinafter, the substantially circular base member 420 and the substantially circular disc member 422 are configured to mate with each other to maintain concentric alignment and limit oscillation of the substantially circular disc member 422 relative to the substantially circular base member 420.

As best shown in FIGS. 15, 16, 18 and 19 the substantially circular base member 420 comprises a substantially circular base element generally indicated as 424 configured to operatively receive and support the substantially circular disc member 422 as described more fully hereinafter. The substantially circular base element 424 includes a centrally disposed aperture 426 formed therethrough to form a substantially circular ring 428 having an outer surface 430 and an inner surface 432 and also including an inner periphery 434 and an outer periphery 436. A circular channel 438 is formed on the inner periphery 434 of the substantially circular ring 428 and a plurality of equally spaced notches each indicated as 440 is formed in the outer surface 430 of the substantially circular ring 428 adjacent the inner periphery 434 thereof to receive portions of the substantially circular disc member 422 as described more fully hereinafter.

The wheel cover 410 is attached to the wheel 412 by a plurality of attachment means each generally indicated as 442 affixed to the inner surface 432 of the substantially circular ring 428 adjacent the outer periphery 436 thereof. Each attachment means 442 may comprise a clip-like configuration as disclosed in copending patent application Ser. No. 08/426,053 filed Apr. 21, 1995 to press fit onto the rim of the wheel 412 or other suitable substitution.

Figure 19:
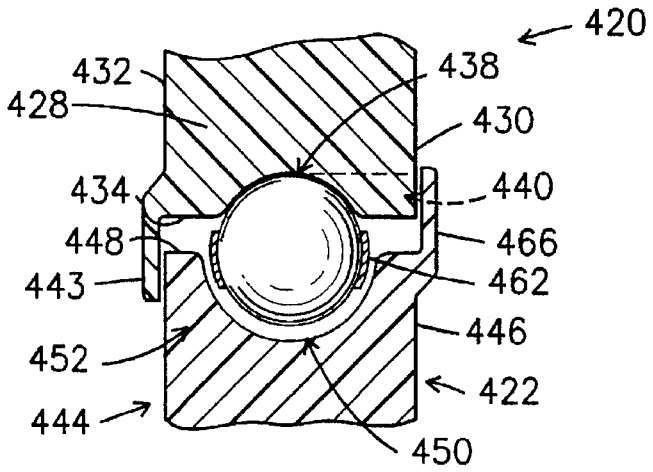
FIG. 19 is a partial cross-sectional side view of the wheel cover shown in FIG. 14.

As best shown in FIG. 19, a base stabilizer/isolater plate or flange 443 is formed on the inner surface 432 of the substantially circular ring 428 adjacent the inner periphery 434 thereof and extends inwardly toward the substantially circular disc member 422 to limit oscillation of the substantially circular disc member 422 relative to the substantially circular base member 420 and to partially isolate the circular channel 438 from the environment.

As best shown in FIGS. 15 and 17 through 19, the substantially circular disc member 422 comprises a substantially circular disc element 444 including a flat outer surface 446 on which indicia or designs may be formed and an outer periphery 448 having a plurality of equally spaced recesses each indicated as 450 formed therein to receive and retain a corresponding plurality of disc mounting elements each generally indicated as 452 therein.

Figure 14:
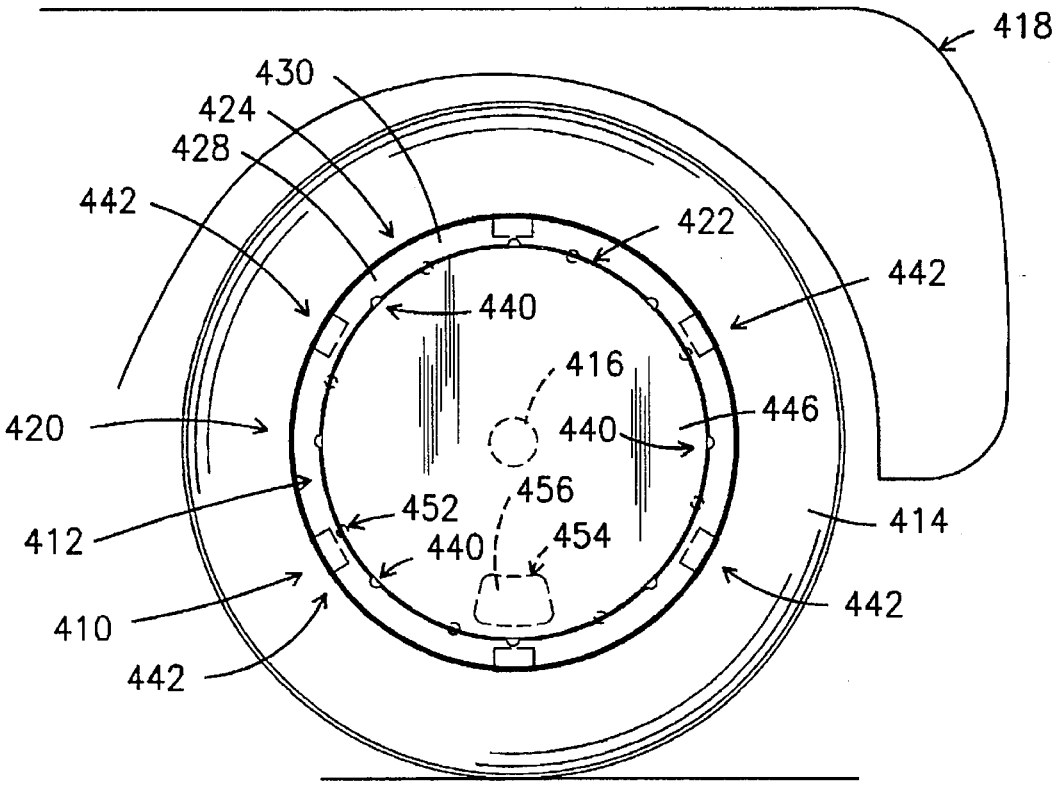
FIG. 14 is a front view of still another alternate embodiment of a wheel cover mounted on a wheel.
Figure 15:
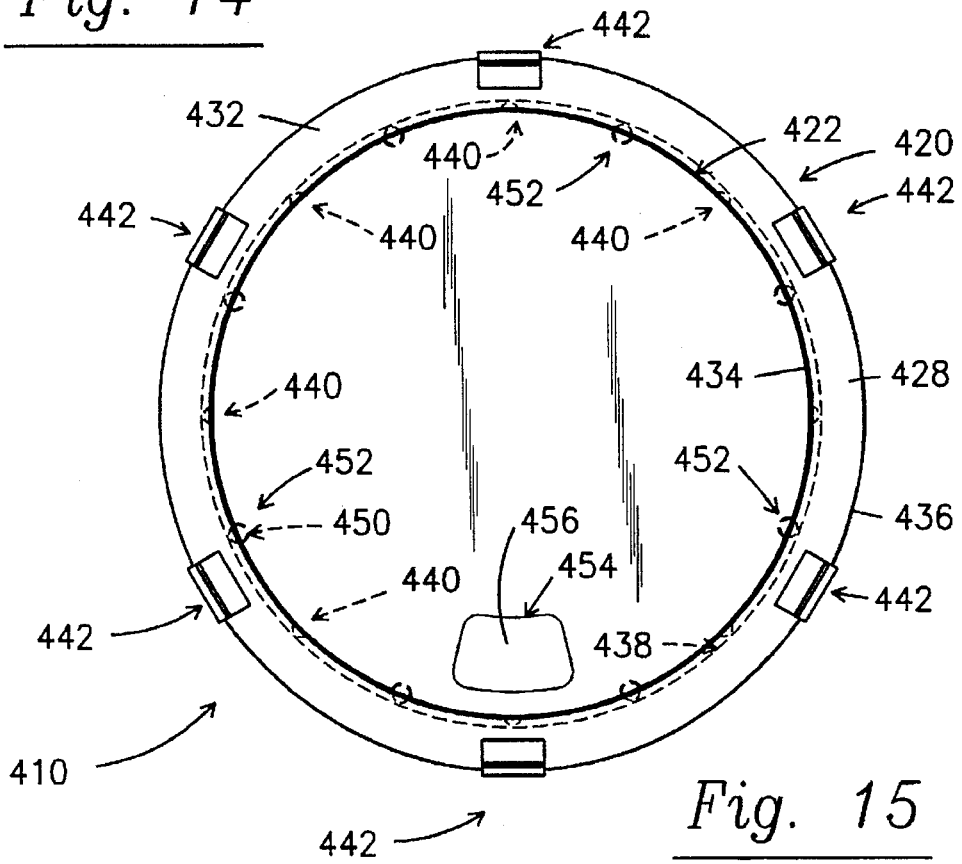
FIG. 15 is a rear view of the wheel cover shown in FIG. 14.
Figure 16:
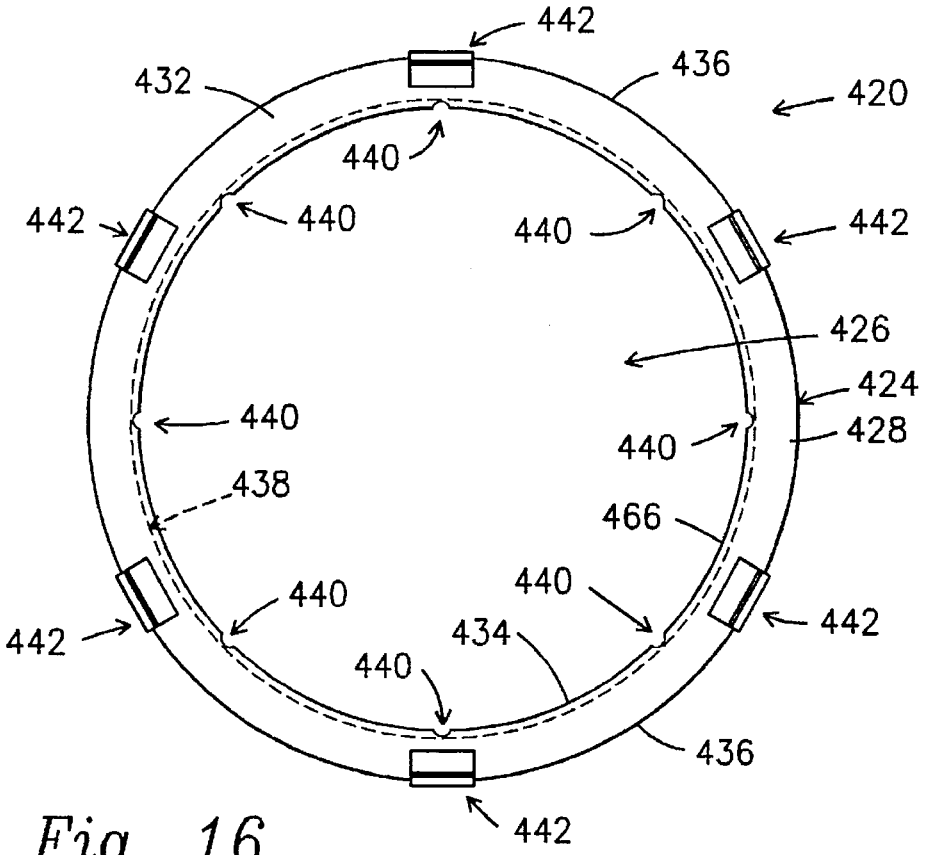
FIG. 16 is a rear view of the base member of the wheel cover shown in FIG. 14.
Figure 17:
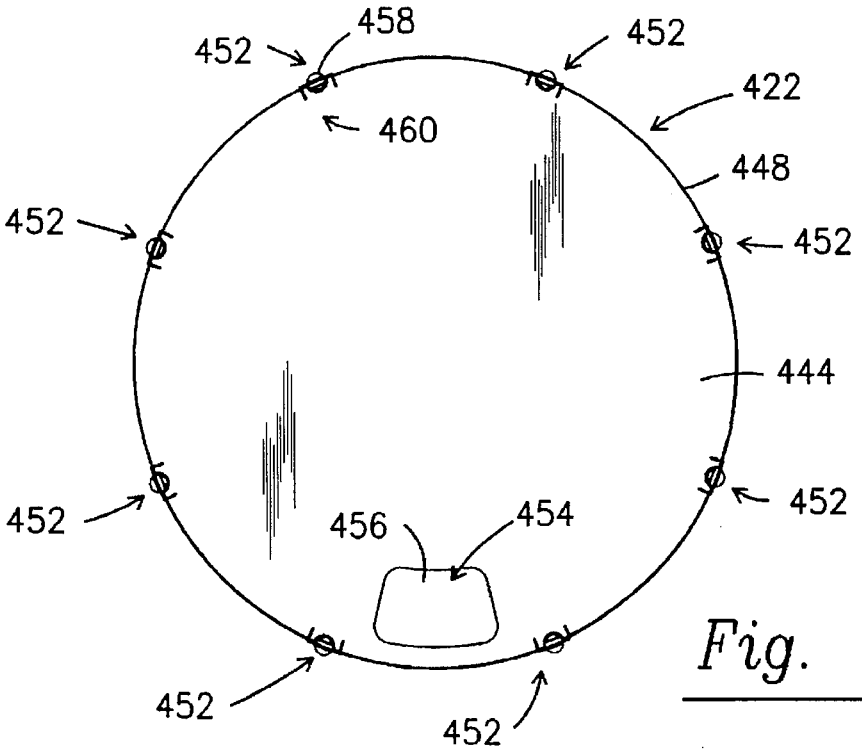
FIG. 17 is a rear view of the disc member of the wheel cover shown in FIG. 14.

As best shown in FIGS. 14, 15 and 17, at least one weight recess 454 is formed in the substantially circular disc element 444 to house a weight 456 to form a means to limit or restrict rotation of the substantially circular disc member 422.

Figure 18:
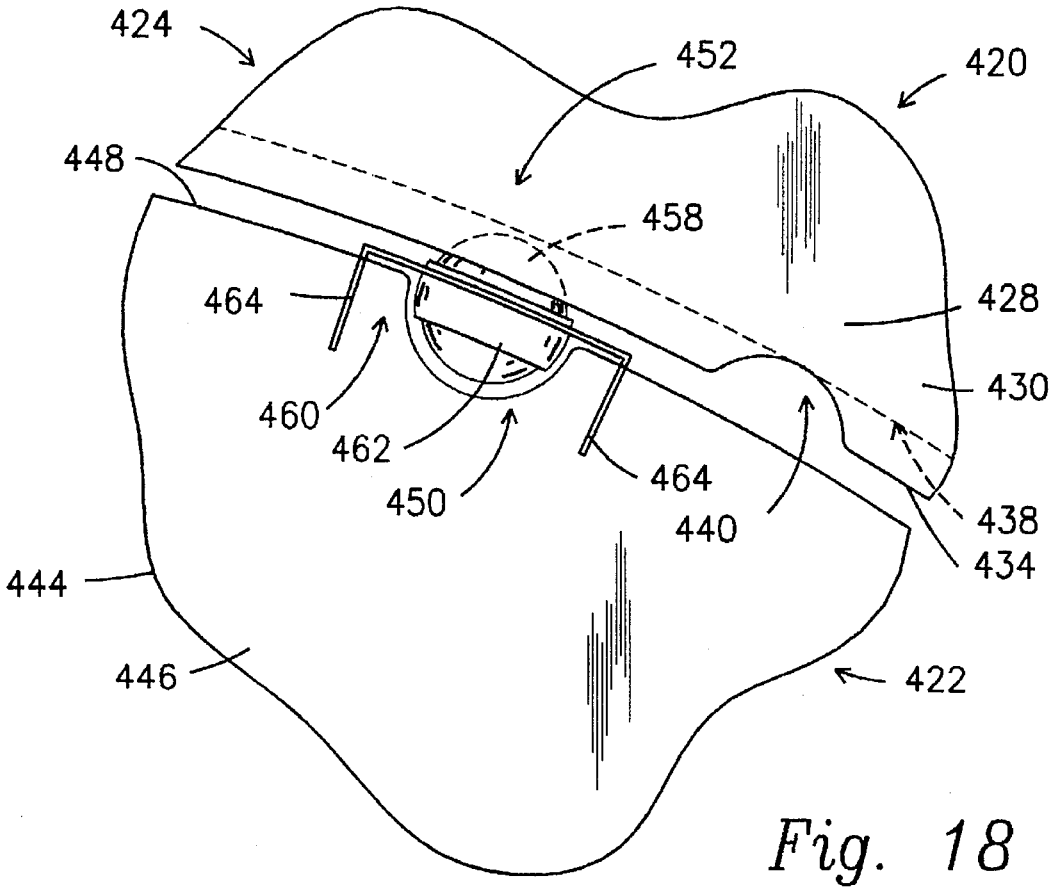
FIG. 18 is a partial detailed front view of the wheel cover shown in FIG. 14.

As best shown in FIGS. 17 through 19, each disc mounting element 452 comprises a ball or spherical member 458 rotatably disposed within the corresponding recess 450 by a corresponding retainer generally indicated as 460. Each retainer 460 comprises a retention ring 462 disposed in surrounding relationship relative to the ball or spherical member 458 having a pair of substantially L-shaped attachment legs each indicated as 464 attached thereto to anchor each disc mounting element 452 to the outer periphery 448 of the substantially circular disc element 444 such that each ball or spherical member 458 is partially disposed in the corresponding recess 450 and partially disposed within the circular channel 438 such that the plurality of disc mounting elements 452 cooperatively form a bearing means between the substantially circular base member 420 and the substantially circular disc member 422 as well as limit lateral movement therebetween.

As best shown in FIG. 19, a disc stabilized isolator plate or flange 466 is formed on the outer surface 446 of the substantially circular disc element 444 adjacent the outer periphery 448 thereof and extends outwardly to limit oscillation of the substantially circular disc member 422 relative to the substantially circular base member 420 and to partially isolate the circular channel 438 from the environment.

As previously set forth, the substantially circular base member 420 and the substantially circular disc member 422 are configured to mate with each other to maintain concentric alignment and limit oscillation of the substantially circular disc member 422 relative to the substantially circular base member 420.

To assemble the wheel cover 410, the substantially circular base member 420 is attached to the wheel 412. The substantially circular disc member 422 is then positioned adjacent the substantially circular base member 420 with each disc mounting element 452 aligned with a corresponding notch 440 allowing the ball or spherical members 458 to pass therethrough.

When assembled, as best shown in FIGS. 14, 15, 18 and 19, the substantially cylindrical disc member 422 is disposed within the centrally disposed aperture 426 such that the substantially circular base member 420 and the substantially circular disc member 422 are disposed in substantially coplanar relationship relative to each other; while, the ball or spherical members 458 are partially disposed within the circular channel 438.

The base stabilizer/isolater plate 443 and disc stabilizer/isolator plate or flange 466 cooperatively form a stabilizer/isolation means that restrict lateral movement of the substantially circular base member 420 and the substantially circular disc member 422 relative to each other and to isolate the circular channel 438, the plurality of recesses 450 and the plurality of disc mounting elements 452 from the surrounding environment.

In use, an appropriate inscription is formed on the flat outer surface 446 of the substantially circular disc member 422. When the tire 414 and wheel 412 mounted on the axle 416 rotate, the substantially circular disc member 422 remains rotationally stationary, not rotating with the wheel 412. This is because the weight 456 retains the substantially circular disc member 422 upright with the disc mounting element 452 at least partially disposed within the circular channel 438.

Figure 21:
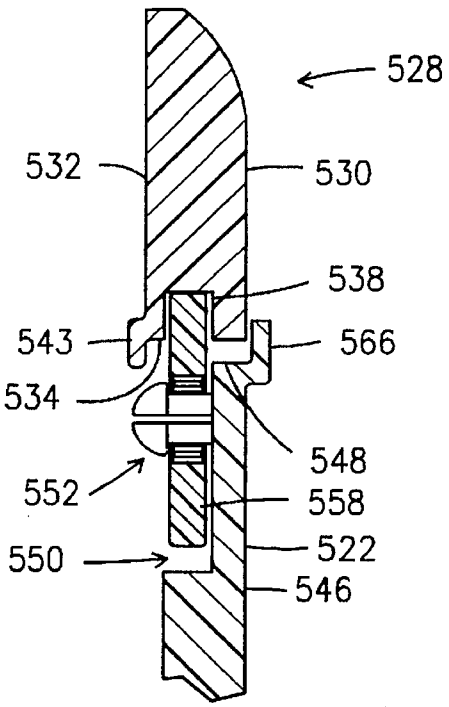
FIG. 21 is a partial cross-sectional side view of the wheel cover shown in FIG. 20.
Figure 20:
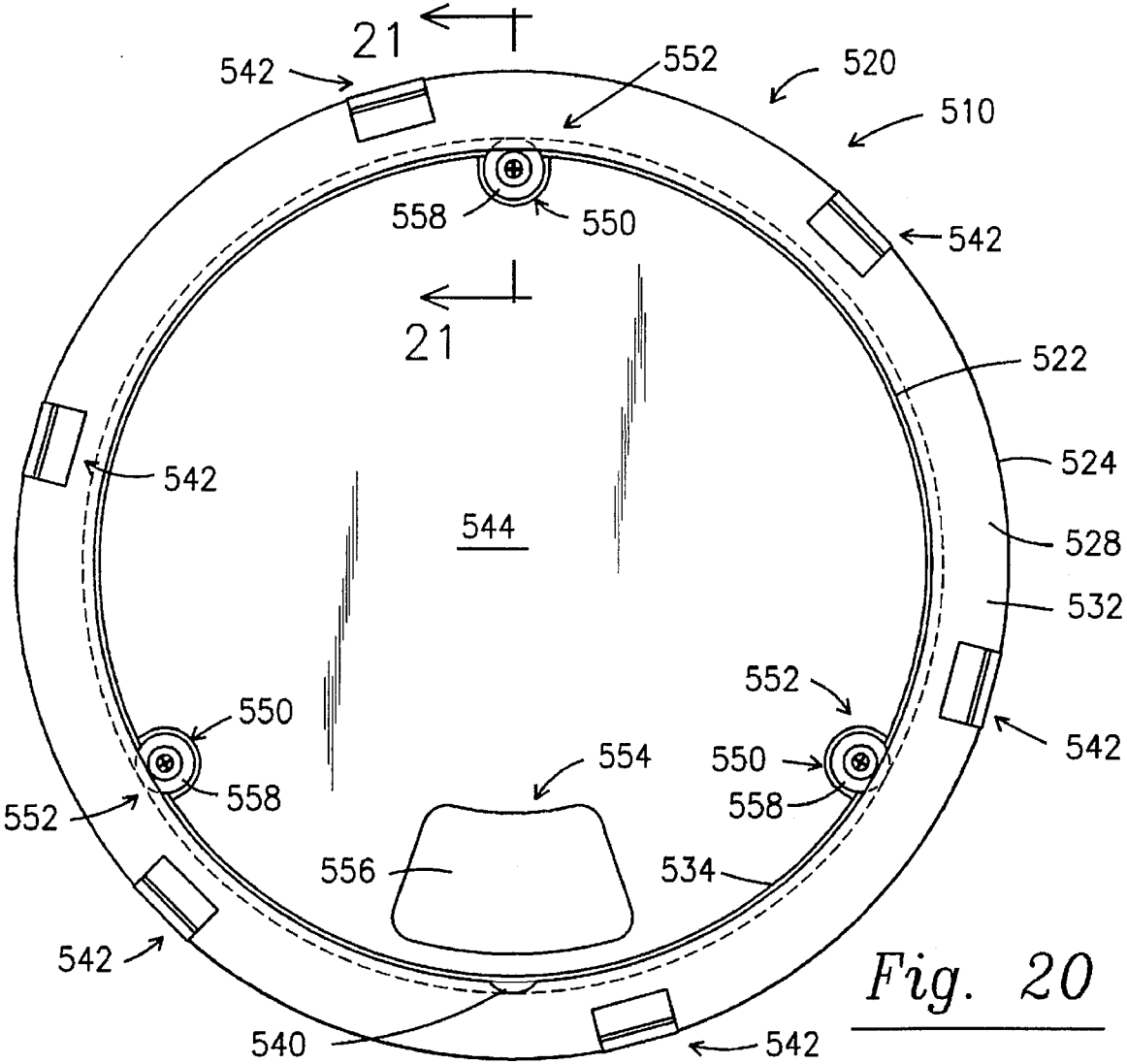
FIG. 20 is a rear view of yet still another alternate embodiment of a wheel cover.

FIGS. 20 and 21 show yet another alternate embodiment of a wheel cover generally indicated as 510 for mounting on a wheel as described in the earlier embodiments.

As best shown in FIG. 20, the wheel cover 510 comprises a substantially circular base member generally indicated as 520 having a substantially circular disc member generally indicated as 522 mounted thereto.

As described more fully hereinafter, the substantially circular base member 520 and the substantially circular disc member 522 are configured to mate with each other to maintain concentric alignment and limit oscillation of the substantially circular disc member 522 relative to the substantially circular base member 520.

As best shown in FIG. 20, the substantially circular base member 520 comprises a substantially circular base element generally indicated as 524 configured to operatively receive and support the substantially circular disc member 522 as described more fully hereinafter. The substantially circular base element 524 includes a centrally disposed aperture 526 formed therethrough to form a substantially circular ring 528 having an outer surface 530 and an inner surface 532 and also including an inner periphery 534 and an outer periphery 536. A circular channel 538 is formed on the inner periphery 534 of the substantially circular ring 528 and a notch 540 is formed in the inner surface 532 of the substantially circular ring 528 adjacent the inner periphery 534 thereof to receive a portion of the substantially circular disc member 522 as described more fully hereinafter.

The wheel cover 510 is attached to the wheel by a plurality of attachment means each generally indicated as 542 affixed to the inner surface 532 of the substantially circular ring 528 adjacent the outer periphery 536 thereof. Each attachment means 542 may comprise a clip-like configuration as disclosed in copending patent application Ser. No. 08/426,053 filed Apr. 21, 1995 to press fit onto the rim of the wheel or other suitable substitution.

As best shown in FIG. 21, a base stabilizer/isolater plate or flange 543 is formed on the inner surface 532 of the substantially circular ring 528 adjacent the inner periphery 534 thereof and extends inwardly toward the substantially circular disc member 522 relative to the substantially circular base member 520 and to partially isolate the circular channel 538 from the environment.

As best shown in FIGS. 20 and 21, the substantially circular disc member 522 comprises a substantially circular disc element 544 including a flat outer surface 546 on which indicia or designs may be formed and an outer periphery 548 having a plurality of equally spaced recesses each indicated as 550 formed therein to receive and retain a corresponding plurality of disc mounting elements each generally indicated as 552 therein.

As best shown in FIG. 20, at least one weight recess 554 is formed in the substantially circular disc element 544 to house a weight 556 to form a means to limit or restrict rotation of the substantially circular disc member 522.

As best shown in FIGS. 20 and 21, each disc mounting element 552 comprises a roller or wheel member 558 rotatably disposed within the corresponding recess 550 by a corresponding retainer generally indicated as 560. Each retainer 560 comprises a retention pin 562 having an enlarged end portion 564 attached thereto to anchor each disc mounting element 552 to the substantially circular disc element 544 such that each roller or wheel member 558 is partially disposed in the corresponding recess 550 and partially disposed within the circular channel 538 such that the plurality of disc mounting elements 552 cooperatively form a bearing means between the substantially circular base member 520 and the substantially circular disc member 522 as well as limit lateral movement therebetween.

As best shown in FIG. 21, a disc stabilizer/isolator plate or flange 566 is formed on the outer surface 546 of the substantially circular disc element 544 adjacent the outer periphery 548 thereof and extends outwardly to limit oscillation of the substantially circular disc member 522 relative to the substantially circular base member 520 and to partially isolate the circular channel 538 from the environment.

As previously set forth, the substantially circular base member 520 and the substantially circular disc member 522 are configured to mate with each other to maintain concentric alignment and limit oscillation of the substantially circular disc member 522 relative to the substantially circular base member 520.

To assemble the wheel cover 410, the substantially circular disc member 522 is positioned adjacent the substantially circular base member 520 with two disc mounting elements 552 disposed within the circular channel 538 and the third disc mounting element 522 with the notch 540 allowing the roller or wheel member 558 to pass therethrough the substantially circular base member 520 and is attached to the wheel 412.

When assembled, as best shown in FIG. 20, the substantially cylindrical disc member 522 is disposed within the centrally disposed aperture 526 such that the substantially circular base member 520 and the substantially circular disc member 522 are disposed in substantially coplanar relationship relative to each other; while, the roller or wheel 558 are partially disposed within the circular channel 538.

The base stabilizer/isolator plate 543 and disc stabilizer/isolator plate or flange 566 cooperatively form a stabilizer/isolation means that restricts lateral movement of the substantially circular base member 520 and the substantially circular disc member 522 relative to each other and to isolate the circular channel 538, the plurality of recesses 550 and the plurality of disc mounting elements 552 from the surrounding environment.

In use, an appropriate inscription is formed on the flat outer surface 546 of the substantially circular disc member 522. When the tire and wheel mounted on the axle rotate, the substantially circular disc member 522 remains rotationally stationary, not rotating with the wheel. This is because the weight 556 retains the substantially circular disc member 522 upright with the disc mounting element 552 at least partially disposed within the circular channel 538.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A wheel cover for mounting on a wheel rim rotationally coupled to a vehicle comprising a base member having a disc member rotatably mounted thereto to display an indicia thereon, said base member comprises a base element including a centrally disposed aperture formed therethrough to form a ring having an outer surface and an inner surface and also including an inner periphery having a circular channel formed therein and a base stabilizing means and said disc member comprises a disc element including an outer surface, a plurality of disc mounting elements at least partially disposed within said circular channel when said base member and said disc member are operatively assembled and a disc stabilizing means configured to mate with each other to maintain concentric alignment and restrict oscillation of said disc member relative to said base member and a counterweight attached to said disc member such that as said base member rotates with the wheel rim said disc member does not rotate relative to the vehicle so that the indicia on said disc member can be viewed as the vehicle translates over a supporting surface, said ring further includes a plurality of notches formed in said outer surface thereof adjacent said inner periphery corresponding to said plurality of disc mounting elements such that each of said plurality of disc mounting elements passed through said corresponding notch as said disc member is mounted on said base member to permit assembly of said wheel cover on said wheel, said base member and said disc member being disposed in substantially coplanar relationship relative to each other.

2. The wheel cover of claim 1 wherein each disc mounting element comprises a spherical member at least partially disposed within a corresponding recess formed in said outer periphery of said disc element.

3. The wheel cover of claim 2 wherein each said disc mounting element further includes a retainer to mount each said spherical member to said disc element.

4. The wheel cover of claim 3 wherein each said retainer comprises a retention ring disposed in surrounding relationship relative to each corresponding spherical member having a pair of attachment legs attached thereto to anchor each disc mounting element to said outer periphery of said disc element such that each said spherical member is partially disposed in said corresponding recess and partially disposed within said circular channel such that the plurality of said disc mounting elements cooperatively form a bearing means between said base member and said disc member as well as limit lateral movement therebetween.

5. The wheel cover of claim 2 wherein said disc stabilizing means comprises a disc flange formed on said outer surface of said disc element adjacent said outer periphery thereof and extends outwardly in overlapping relationship relative to said inner periphery of said base member to limit oscillation of said disc member relative to said base member and said base stabilizing means comprises a base flange formed on said inner surface of said ring adjacent said inner periphery thereof and extends inwardly in overlapping relationship relative to said outer periphery of said disc member to limit oscillation of said disc member relative to said base member, said base flange and said disc flange being disposed on opposite sides of said wheel cover to cooperatively form an isolation means to isolate said circular channel, said plurality of recesses and said plurality of disc mounting elements from outside said wheel cover.

6. Wheel cover for mounting on a wheel rim rotationally coupled to a vehicle comprising a base member having a disc member rotatably mounted thereto to display an indicia thereon, said base member includes a base stabilizing means and said disc member includes disc stabilizing means configured to mate with each other to maintain concentric alignment and restrict oscillation of said disc member relative to said base member and a counterweight attached to said disc member such that as said base member rotates with the wheel rim said disc member does not rotate relative to the vehicle so that the indicia on said disc member can be viewed as the vehicle translates over a supporting surface, said base member and said disc member being disposed in substantially coplanar relationship relative to each other, wherein said base member comprises a base element including a centrally disposed aperture formed therethrough to form a ring having an outer surface and an inner surface and also including an inner periphery and an outer periphery, and said disc member comprises disc element including an outer surface and an outer periphery and wherein said inner periphery includes a circular channel formed therein and said disc member further includes a plurality of disc mounting elements at least partially disposed within said circular channel when said base member and said disc member are operatively assembled.

7. The wheel cover of claim 6 wherein said ring further includes a plurality of notches formed in said outer surface thereof adjacent said inner periphery corresponding to said plurality of said plurality of disc mounting elements such that each of said plurality of disc mounting elements passed through said corresponding notch as said disc member is mounted on said base member to permit assembly of said wheel cover on the wheel.

8. The wheel cover of claim 6 wherein each disc mounting element comprises a spherical member at least partially disposed within a corresponding recess formed in said outer periphery of said disc element.

9. The wheel cover of claim 8 wherein each said disc mounting element further includes a retainer to mount each said spherical member to said disc element.

10. The wheel cover of claim 9 wherein each said retainer comprises a retention ring disposed in surrounding relationship relative to each corresponding spherical member having a pair of attachment legs attached thereto to anchor each disc mounting element to said outer periphery of said disc element such that each said spherical member is partially disposed in said corresponding recess and partially disposed within said circular channel such that the plurality of said disc mounting elements cooperatively form a bearing means between said base member and said disc member as well as limit lateral movement therebetween.

11. The wheel cover of claim 8 wherein said disc stabilizing means comprises a disc flange formed on said outer surface of said disc element adjacent said outer periphery thereof and extends outwardly in overlapping relationship relative to said inner periphery of said base member to limit oscillation of said disc member relative to said base member.

12. The wheel cover of claim 11 wherein said base stabilizing means comprises a base flange formed on said inner surface of said ring adjacent said inner periphery thereof and extends inwardly in overlapping relationship relative to said outer periphery of said disc member to limit oscillation of said disc member relative to said base member.

13. The wheel cover of claim 12 wherein said base flange and said disc flange being disposed on opposite sides of said wheel cover to cooperatively form an isolation means to isolate said circular channel, said plurality of recesses and said plurality of disc mounting elements from outside said wheel cover.

14. A wheel cover for mounting on a wheel rim rotationally coupled to a vehicle comprising a base member having a disc member rotatably mounted thereto to display an indicia thereon, said base member comprising a base element including a centrally disposed aperture formed therethrough to form a ring having an outer surface and an inner surface and also including an inner periphery and an outer periphery and a base stabilizing means comprising a base flange formed on said inner surface of said ring adjacent said inner periphery thereof and extending inwardly in overlapping relationship relative to said outer periphery of said disc member to limit oscillation of said disc member relative to said base member and said disc member includes a disc stabilizing means comprising a disc flange formed on said outer surface of said disc element adjacent said outer periphery thereof and extends outwardly in overlapping relationship relative to said inner periphery of said base member to limit oscillation of said disc member relative to said base member and a counterweight attached to said disc member such that as said base member rotates with the wheel rim said disc member does not rotate relative to the vehicle so that the indicia on said disc member can be viewed as the vehicle translates over a supporting surface, said base member and said disc member being disposed in substantially coplanar relationship relative to each other and wherein said base element further includes a circular channel formed in the inner periphery thereof and said disc member further includes a plurality of disc mounting elements at least partially disposed within said circular channel when said ring and said disc member are operatively assembled.

15. The wheel cover of claim 14 wherein said ring further includes a plurality of notches formed in said outer surface thereof adjacent said inner periphery corresponding to said plurality of disc mounting elements such that each of said plurality of disc mounting elements passed through said corresponding notch as said disc member is mounted on said base member to permit assembly of said wheel cover on the wheel.

16. The wheel cover of claim 15 wherein each disc mounting element comprises a spherical member at least partially disposed within a corresponding recess formed in said outer periphery of said disc element and a retainer to mount each said spherical member to said disc element, each said retainer comprises a retention ring disposed in surrounding relationship relative to each corresponding said spherical member and having at least an attachment leg attached thereto to anchor each said disc mounting element to said outer periphery of said disc element such that each said spherical member is partially disposed in said corresponding recess and partially disposed within said circular channel such that the plurality of said disc mounting elements cooperatively form a bearing means between said base member and said disc member as well as limit lateral movement therebetween.

* * * * *